United States Patent [19]

Goldfarb et al.

[11] 4,054,287

[45] Oct. 18, 1977

[54] TOY AMUSEMENT ARCADE

[75] Inventors: Adolph E. Goldfarb, Tarzana; Erwin Benkoe, Encino; Delmar K. Everitt, Woodland Hills; Ronald F. Chesley, La Crescenta; Richard D. Frierdich, Canoga Park, all of Calif.

[73] Assignees: Adolph E. Goldfarb; Erwin Benkoe, both of Northridge, Calif.

[21] Appl. No.: 657,485

[22] Filed: Feb. 12, 1976

[51] Int. Cl.[2] ..... A63B 65/12; A63F 7/00

[52] U.S. Cl. ..... 273/101; 273/95 D; 273/119 R; 273/121 R; 273/127 D

[58] Field of Search ..... 273/95 A, 95 D, 98, 273/101, 102 AP, 102.1 R, 102.1 G, 118 R, 119 R, 121 R, 127 R, 127 D, 105 R; 35/8 R

[56] References Cited

U.S. PATENT DOCUMENTS

| | | | |
|---|---|---|---|
| 695,386 | 3/1902 | Graves | 273/101 |
| 1,352,309 | 9/1920 | Myers | 273/95 A |
| 1,412,625 | 4/1922 | Nelson | 273/101 |
| 1,599,579 | 9/1926 | Milewski | 273/119 R |
| 1,631,006 | 5/1927 | Brown | 273/102 AP |
| 1,991,610 | 2/1935 | Gaus | 273/102.1 G |
| 2,578,375 | 12/1951 | Sire | 273/101 |
| 3,538,620 | 11/1970 | Kohner et al. | 35/8 R |
| 3,594,001 | 7/1971 | Glass et al. | 273/105 R X |
| 3,637,213 | 1/1972 | Breslow et al. | 273/101 |
| 3,724,853 | 4/1973 | Crowder | 273/95 A X |
| 3,853,318 | 12/1974 | Cagan | 273/102.1 G |

*Primary Examiner*—Richard C. Pinkham
*Assistant Examiner*—Vance Y. Hum
*Attorney, Agent, or Firm*—Robert M. Ashen; Robert J. Schaap

[57] ABSTRACT

A preschool toy amusement arcade which includes a base frame having a plurality of amusement arcade games thereon. Each of the amusement games are designed so that they are self-contained and include no loose parts. In each of the games, a moving part is tied to some part of the arcade by a flexible connector, or otherwise a moving part is contained within a completely enclosed housing. Thus, the amusement arcade may contain all game features where the moving part is located in an enclosed housing. Otherwise, the arcade may contain one or more game features where the moving part is connected to the arcade by a flexible connector. Game features which utilize a moving part connected to the game by a flexible connector may adopt the form of a simulated gun range where a simulated gun issues a projectile toward a target member located to be contacted by the projectile. The flexible connector is attached to the simulated gun and to the projectile in order to prevent uncontrolled movement of the projectile or the losing of the projectile. The other types of games which employ completely enclosed housings, preferably have a transparent top. In this latter type of game a scoring element, such as a spherical object, can be released from a shooter mechanism for issuing the spherical object toward a form of target device or receiving member. An actuating member may be located exteriorly of the housing in order to actuate the shooter mechanism to thereby propel the spherical object toward the receiving member.

7 Claims, 10 Drawing Figures

TOY AMUSEMENT ARCADE

BACKGROUND OF THE INVENTION

This invention relates in general to certain new and useful improvements in preschool children's toy amusement arcades and, more particularly, to amusement arcades which are self-contained and which include no loose parts.

The various types of toys and toy games which may be designed for preschool children are necessarily limited due to various practical and legal constraints. It is established that preschool toys or toy games must be constructed with sufficient durability in order to withstand the abuse normally subjected thereby by children of preschool age. In addition, there are several legal constraints with regard to small components which might be swallowed by a child. In addition, small movable parts are easily lost, thereby destroying the effectiveness and ability to use the toy or play the toy game.

There are no commercially available amusement toy arcades designed to simulate a real amusement arcade which would normally have to include a number of small movable parts which might be either swallowed or otherwise lost by children of preschool age. For example, a typical amusement arcade may include a shooting range, such as a rifle range, in which a projectile is issued from a shooter toward a target. Moreover, amusement aracades may often include various forms of games in which a scoring element is issued toward a scoring member, as for example, the issuance of a ball toward any one of a plurality of score-receiving recesses. However, since any form of amusement arcade designed for preschool children would normally include spherical objects and other small parts which could be easily lost or otherwise swallowed by children, there have been no commercially available and effective toy amusement aracades for children of preschool age.

It is, therefore, a primary object of the present invention to provide a toy amusement arcade for preschool children and which is essentially self-contained and includes no loose parts.

It is another object of the present invention to provide a toy amusement arcade device for preschool children of the type stated and which includes a projectile capable of being issued from a shooter member toward a target, and which projectile is tied to the arcade device by a flexible connector means.

It is a further object of the present invention to provide a toy amusement arcade for preschool children of the type stated and which includes playing games having movable spherical objects within enclosed housings.

It is an additional object of the present invention to provide a toy amusement arcade for preschool children of the type stated and which is highly durable in its construction, and which can be made at a relatively low unit cost.

With the above and other objects in view, our invention resides in the novel features of form, construction, arrangement and combination of parts presently described and pointed out in the claims.

SUMMARY OF THE DISCLOSURE

A toy amusement arcade designed for children of preschool age and having a main frame with a plurality of toy game features located on the main frame. One of the toy game features may adopt the form of a shooting range, or so-called "gun range", in which a shooter or projectile issuing member, as for example, a simulated gun, is mounted on the main frame. A target member is located with respect to the projectile issuing member to be contacted by a projectile issued by the projectile issuing member. A flexible connector means, such as a cord, connects the projectile to the frame or otherwise the projectile issuing member, so as to prevent loss or removal of the projectile from the toy arcade.

The toy amusement arcade will also include at least one second game on the frame means. The second game could adopt a wide variety of forms. However, typically, the second game will be located within a completely enclosed housing and, in a preferred embodiment, the housing is provided with a transparent upper surface. Located within the housing is a scoring element which may adopt the form of a projectile, such as a spherical element. A spherical element shooter mechanism or trigger mechanism is also provided within the housing for issuing the spherical element toward a receiving member. An actuating mechanism is located exteriorly of the enclosed housing for manual actuation by the player. This actuating mechanism could adopt the form of a trigger or lever or other for of actuating member to actuate the spherical element shooter mechanism. In this way, the spherical element can be moved to a receiving member. In addition, the housing is designed so that the spherical element can be automatically returned to the spherical element shooter mechanism.

It is not always necessary or desirable to employ a game feature where a moving object is connected by a flexible connector. Thus, two or more of the second game features could be used in the toy arcade, that is, game features where the movable object is always located in an enclosed housing. Accordingly, the second game feature mentioned above may adopt various characterizations in that the spherical element can enter a score depicting section, such as one of a plurality of recesses in order to obtain a score. Moreover, the second game can adopt the form of a simulated pin ball machine type of game. The receiving member may be an actuable member which will shift or pivot upon contact by the spherical element. Thus, in one form of construction, the receiving member may be a target plate which is located to be contacted by the spherical element. Upon contact, the target plate can pivot, and thereby cause an amusement function to occur, as for example, dumping a simulated clown into a simulated tub of water.

BRIEF DESCRIPTION OF THE DRAWINGS

Figure 1:
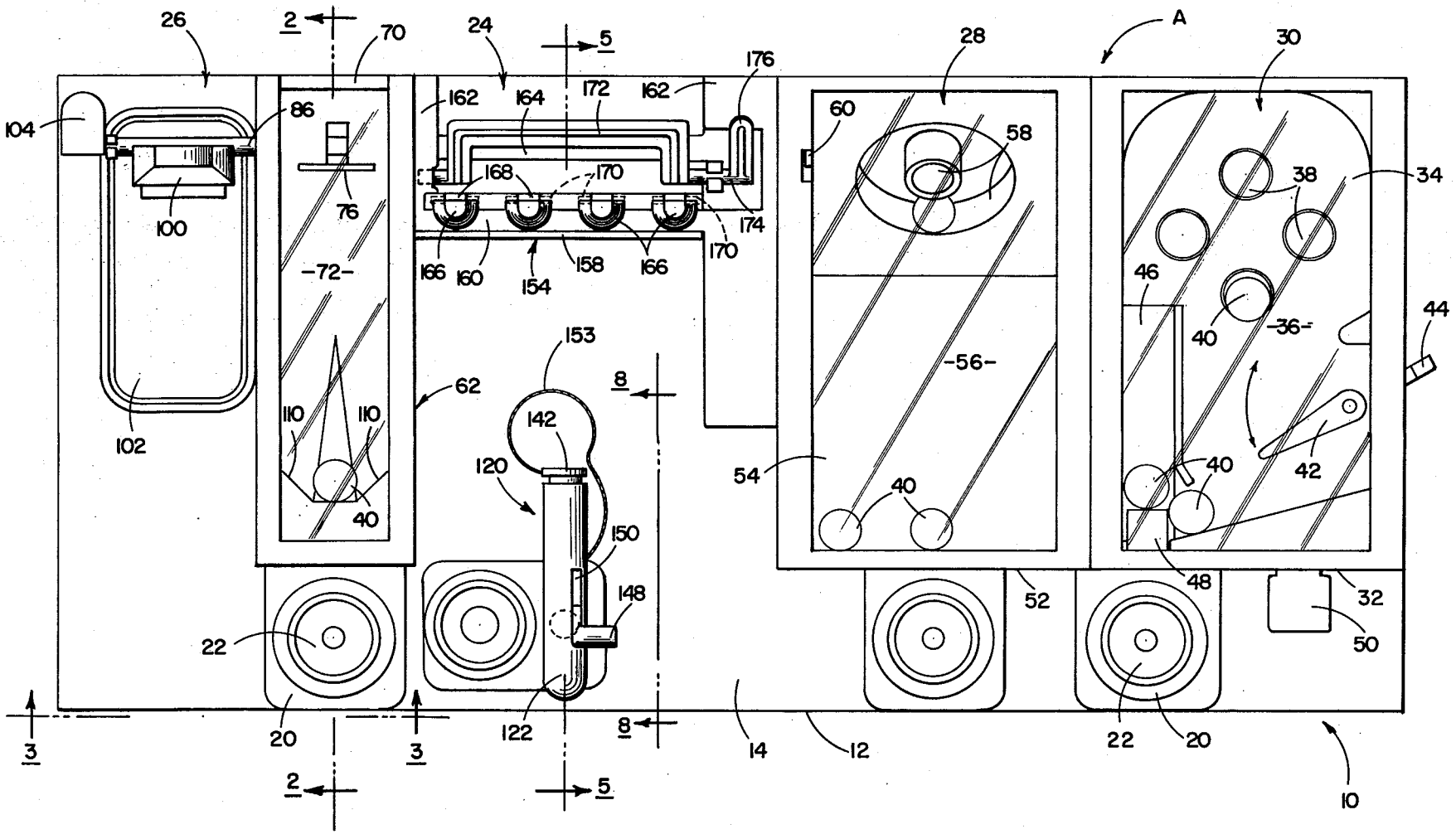
Figures 2, 3, 4, 10:
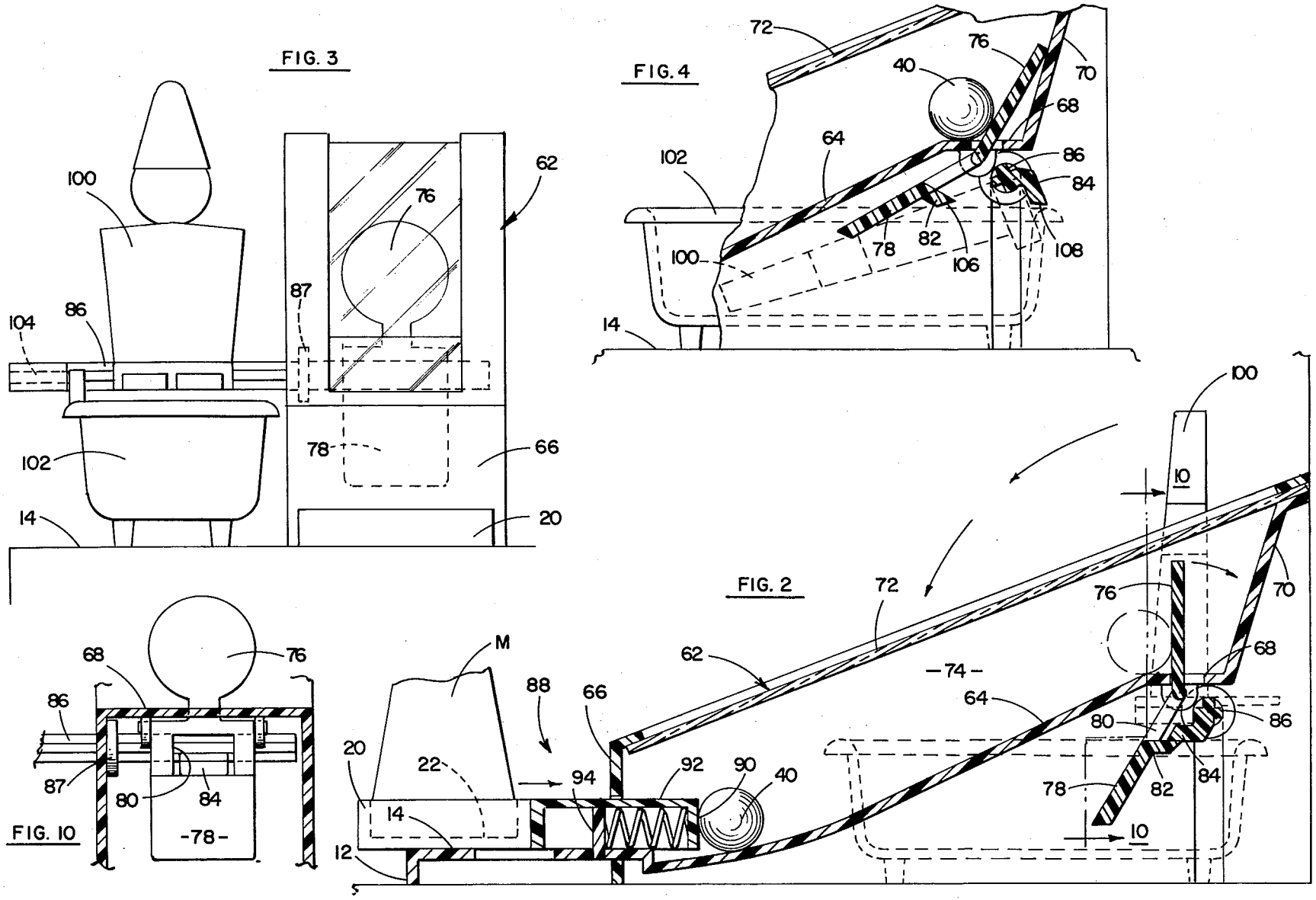
Figure 8:
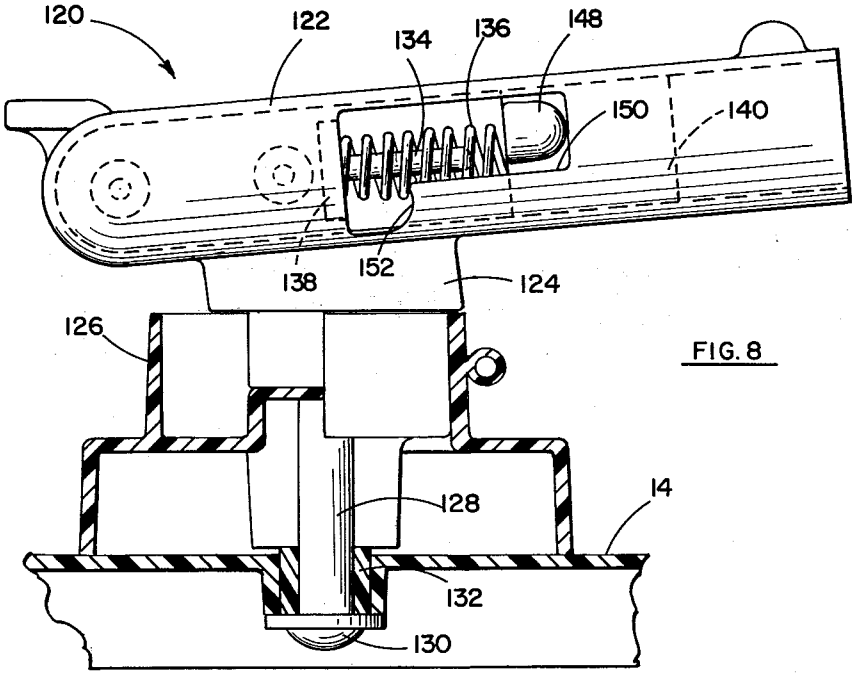
Figure 5:
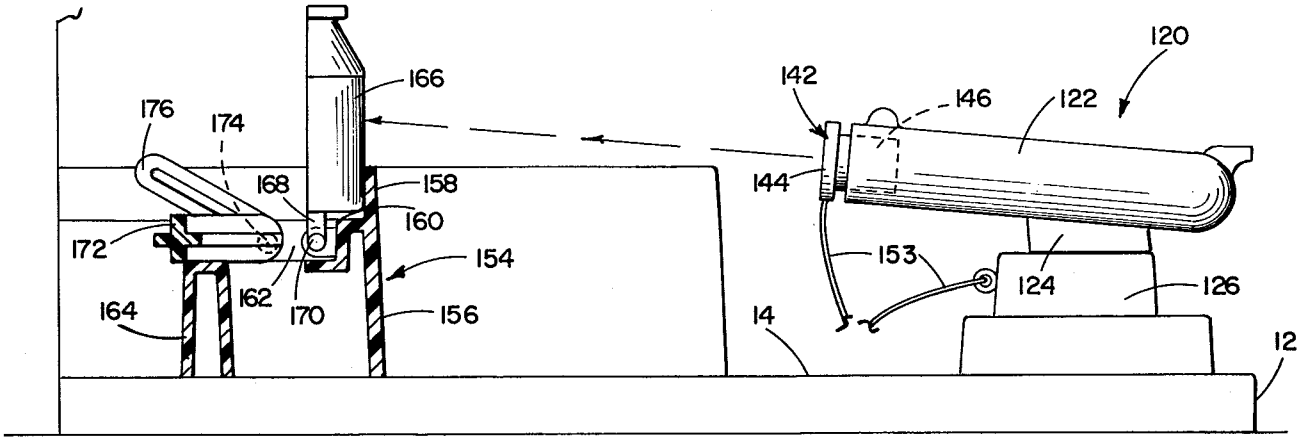
Figure 9:
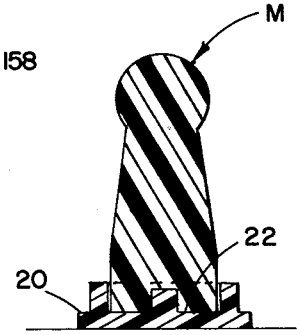
Figure 6:
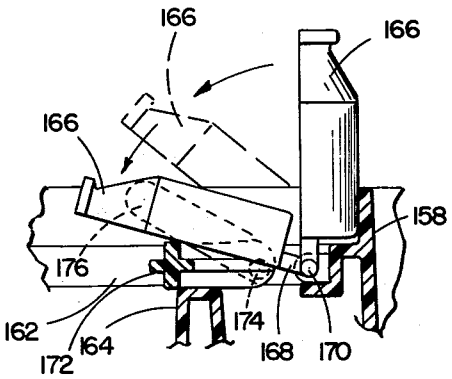
Figure 7:
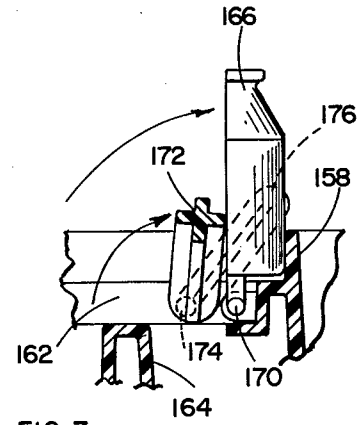

Having thus described the invention in general terms, reference will now be made to the accompanying drawings in which:

FIG. 1 is a top plan view of a toy amusement arcade constructed in accordance with and embodying the present invention;

FIG. 2 is a vertical sectional view taken along line 2—2 of FIG. 1 and showing a form of simulated game forming part of the toy amusement arcade of the present invention;

FIG. 3 is an enlarged front end elevational view of a second game enclosed in a housing, partially shown in section and taken substantially along line 3—3 of FIG. 1;

FIG. 4 is an enlarged vertical sectional view showing a portion of the mechanism of FIG. 2;

FIG. 5 is a vertical sectional view, taken along line 5—5 of FIG. 1, and showing a form of a simulated gun range forming part of the amusement arcade of the present invention;

FIG. 6 is a vertical sectional view of a target means used in the simulated gun range of FIG. 5;

FIG. 7 is a vertical sectional view, similar to FIG. 6, and showing the target means in an alternate position;

FIG. 8 is a side elevational view, partially broken away and in section, of a simulated gun forming part of the gun range of FIG. 5; and FIG. 9 is a vertical sectional view taken along line 9-9 of FIG. 2.

FIG. 10 is a fragmentary vertical sectional view taken along line 10—10 of FIG. 2.

DETAILED DESCRIPTION

Referring now in more detail and by reference characters to the drawings which illustrate practical embodiments of the present invention, A designates a toy amusement arcade generally designed for children of preschool age. The toy arcade includes a base 10 having a depending peripheral support wall 12 and a base wall 14.

Located on the base wall 14 are a plurality of individual amusement features and, for this purpose, these individual amusement features will be referred to as amusement games. Also provided for each amusement game is an upstanding cup-forming wall 20 located on the base wall 14 in relationship to each of the amusement games, and each of these cup-forming walls form a recess or receiving cup 22 which is capable of receiving an object M sized and shaped to simulate a player. One or more of these simulated players M may be provided with the amusement arcade. Moreover, in some cases, the receiving cup 22 may be passive, that is, it is merely designed to retain a simulated player, or otherwise it may be an active receiving cup which coacts with and operates one of the playing games.

Referring to FIG. 1, it can be observed that four individual amusement games are mounted on the base 10, and one of these amusement games constitutes a first amusement game in the form of a simulated gun range 24. The base 10 is also provided with three second amusement game forms which are all characterized by a moving spherical object within an enclosed housing, and includes a "dunking a clown" game 26, a skeet ball game 28, and a pin ball machine 30.

The pin ball machine game 30 is only shown in general form and includes an outer housing 32 mounted on the base wall 14 and having an upper transparent cover 34 for viewing into the interior of the housing 32. The housing 32 is similarly provided with a playing surface 36 having a plurality of ball receiving apertures 38 which are sized to receive a spherical object, such as a ball 40. The pin ball machine game 30 is also provided with a flipper arm 42 actuable by a lever 44 extending outwardly of the housing 32. Moreover, a chute 46 is provided to permit release of a ball 40 onto the playing surface and is actuable by a hammer 48 which is, in turn, operable by pulling rearwardly on the receiving cup 22 associated with the game 30. In this case, by merely pulling on the cup wall 20, the hammer 48 will be urged rearwardly under compression and then released to shoot the ball through the chute 46 onto the playing surface. The hammer 48 may be directly connected to and movable with the cup 22. Otherwise, if desired, a linkage could be used to connect the hammer 48 to the cup 22 and since said linkage would be conventional in its construction, it is, therefore, neither illustrated nor described herein. A depressible lever 50 is located exteriorly of the housing 32. This lever 50 is connected to plugs located in each of the apertures 38 which are shiftable when the lever 50 is pressed to retrieve the ball 40 from the associated apertures 38. Again, this construction is conventional and therefor neither illustrated nor described in any further detail herein.

The skeet ball game 28 also comprises an enclosing housing 52 mounted on the base wall 14 and further includes a transparent cover 54. In this case, the skeet ball game 28 also includes a playing surface 56 having a plurality of goal receiving cups 58. The spherical object can be propelled toward the cups 58 by means of pulling backwardly on the wall 20 of the receiving cup 22 to actuate a plunger in a recess 59 on the playing surface 56. Thus, the receiving cup 22 associated with the skeet ball game 28 as well as the receiving cup 22 associated with the game 30 are active receiving cups which operate to shoot the spherical object 40 toward the goal receiving cups 58 or the apertures 38. In the game 28, the ball may be removed from the goal receiving cups and permitted to slide backwardly down an inclined plane forming part of the playing surface 56 and toward the recess 59, by means of a lever 60 located exteriorly of the housing 52. Again, it can be observed that the actual linkage which causes the release of the ball by actuation is conventional in construction and is therefore neither illustrated nor described in any further detail herein.

The "dunk the clown" game 26 is more fully illustrated in FIGS. 2—4 of the drawings. The game 26 also comprises an outer housing 62 mounted on the base wall 14. In this case, the outer housing 62 comprises a somewhat inclined bottom wall 64 having an upstanding front wall 66 and a relatively horizontal shoulder portion 68 which merges into an upstanding back wall 70. The entire housing 62 is enclosed by a transparent top cover 72 which forms an internal playing chamber 74. A target plate 76 is located within the playing chamber 74 and pivotally mounted on the longitudinal side walls of the housing 62. The target plate 76 has a depending counterweight 78 beneath the housing 62 and which is interrupted by a slot 80. Projecting rearwardly from the counterweight 78 in the region of the slot 80 is a locking tab 82 and which is designed to mate and lock with a similar locking tab 84 formed on a transversely extending pivot rod 86. By reference to FIG. 3, it can be observed that the pivot rod may be journalled within one of the longitudinal side walls of the housing 62 by means of a retainer collar 87 and extends outwardly from the housing 62 for reasons which will presently more fully appear.

Located on the front wall 66 of the housing 62 is a ball shooter mechanism 88 which comprises a hammer 90 and which may be loaded by a compression spring 92. An upstanding flange 94 formed with the base wall 14 forms a stop for the compression spring 92 during the shifting movement of the hammer 90.

The receiving cup 22 associated with the game 26 is capable of transversely shiftable movement relative to the base wall 14. In this case, the receiving cup 22 is mounted on a plate 96 which is integral with and extends forwardly of the hammer 90, in the manner as illustrated in FIG. 2. When the player wishes to release a spherical object, such as the ball 40, the player will merely insert the simulated player M into the receiving cup 22 and pull the same outwardly with respect to the base wall 14 to pull the hammer 90 forwardly and compress the spring 92. Upon release, the hammer 90 will be urged rearwardly under the action of the compression spring 92 and force the ball 40 toward the target plate 76.

FIG. 2 illustrates the target plate 76 in its upright position, and FIG. 4 illustrates the position of the target plate 76 when contacted by the spherical object 40. It can be observed that when the spherical object does contact the target plate 76, it will urge the same rearwardly about its pivotal axis. As this occurs, the two locking tabs 82 and 84 will become disengaged from each other permitting the pivot rod 86 to rotate in a counter-clockwise direction, reference being made to FIG. 4 of the drawings.

Referring now to FIGS. 1 and 3, it can be observed that a simulated clown 100 is mounted on the pivot rod 86, outwardly of the housing 62. Moreover, the simulated clown 100 is located in relation to a tub 102, the latter being mounted on the base wall 14, and which simulates a tub of water. In this way, when the spherical object 40 contacts the target plate 76, and the locking tabs 82 and 84 are released from each other, the pivot rod 86 will rotate and thereby permit the simulated clown 100 to rotate into the tub 102.

A flange 104 is mounted on the outer end of the pivot rod 86 and is designed to be manually engaged by the fingers of the player to rotate the rod 86 in a clockwise direction, reference being made to FIG. 4, and to thereby raise the clown 100 to its upright position, as illustrated in FIG. 3. As the pivot rod 86 is so rotated, camming surfaces 106 and 108 on the outer ends of each of the locking tabs 82 and 84 respectively will engage each other, thereby causing an initial movement of the counterweight 78 and the pivot rod 86 to a position approaching that of FIG. 2. At a certain point, the camming surface 108 will pass over the camming surface 106 and engage the upper surface of the locking tab 82 in the manner as illustrated in FIG. 2. In this way, the target plate 76 will then be retained in the upright position until again contacted by a spherical object. In the same respect, it can be observed that the horizontal shoulder 68 is sufficiently narrow so that when the spherical object 40 contacts the target plate 76, it will automatically roll down the bottom wall 64 toward the shooter mechanism 88. The bottom wall 64 is provided with a pair of bumper pads 110 which guide the spherical object 40 toward the shooter mechanism 88.

One of the unique features to be noted with respect to the second game devices, such as the games 26, 28 and 30, is that each of these games includes a spherical object which is completely within an enclosed housing so that the spherical object cannot be inadvertently removed or lost. Each of these housings include a transparent top so that the player of the toy arcade can easily view the activity within the housing. Moreover, each of the housings contain some form of external actuating mechanism to at least actuate a shooter mechanism of some form and move the spherical object toward a target device or some form of receiving member, thereby avoiding the necessity of a player gaining access to the interior of the housings forming these various games.

The simulated gun range game 24 is more fully illustrated in FIGS. 5–8 of the drawings. In this case, it can be observed that the simulated gun range game 24 comprises a simulated gun 120 having a barrel 122 which is provided with a downwardly struck flange 124 and which extends into an upstanding retaining boss 126 mounted on the base wall 14. A pivot pin 128 is secured to the depending flange 124 and is retained in the base wall 14 and extends through the upstanding boss 126, in the manner as illustrated in FIG. 8. The pivot pin 128 may be provided with an enlarged head 130 and retained in the sleeve 132 which serves as a form of bearing. In this way, the player of the game can pivot the gun barrel 122 relative to targets at the rear of the game, and which targets are hereinafter described in more detail.

The gun barrel 122 internally includes a fixed guide pin 134 surrounded by a compression spring 136 and which bears against an inner wall 138 at one end, and a shiftable head 140 at the opposite end for engaging projectile 142. The projectile 142 may be conventionally provided with a plate 144 and an outwardly struck sylindrical plug 146 which extends into the bore of the barrel 122. In this way, upon release, the spring 136 will urge the head 140 outwardly so that the head 140 can contact the plug 146 and urge the projectile 142 in a trajectory toward the targets hereinafter defined.

An outwardly extending handle 148 (FIG. 19 extends through a slot 150 on the barrel 122 and is integral with the head 140 for compressing the spring 136. Moreover, the slot 150 may be provided with a recess 152 (FIG. 8) for pushing the handle 148 downwardly and into a locked position where the gun is essentially cocked for purposes of firing. Upon firing of the gun, the player merely pushes the handle upwardly from the recess 152 so that the handle 148 is permitted to slide forwardly and thereby permit the head 140 to contact the projectile 142.

The projectile 142 is connected to the upstanding boss 126 by means of a flexible cable 153. In this case, the cable may be conveniently connected to the plate 144 of the projectile 142 and to the boss 126 by means of any suitable adhesive or like attachment means. In addition, the cable could be connected to any other portion of the apparatus for at least preventing the loss of the projectile 142. For this purpose, any flexible cable, such as a piece of string or the like, may be utilized.

The targets used in connection with the gun range game are more fully illustrated in FIGS. 5–7 of the drawings. In this case, it can be observed that an upstanding retaining bracket 154 is mounted on the base wall 14 in transversely spaced apart relationship to the simulated gun 120. The bracket 154 includes an upstanding front wall 156, with a forwardly presented, vertically disposed retaining flange 158 and a horizontal support element 160. In addition, the bracket 154 comprises an inverted U-shaped rear leg 164. A pair of longitudinally spaced apart transversely extending plates 162 are located between the front leg 156 and the rear leg 164. Mounted on the horizontal element 160 in proximity to the front wall 156 of the bracket 154 are a plurality of targets designated as 166 and which targets adopt the form of a simulated bottle. The bottles are each provided with a depending tab 168 which extends into individual slots in the horizontal element 160 and are pivotally mounted on the horizontal element 160 through pivot pins 170 which extend into circular retaining lugs as shown.

Also mounted on each of the mounting plates 162 in rearwardly spaced relationship to the bottle-forming targets 166 is a shiftable retainer bracket 172. The shiftable retainer bracket 172 is mounted on a common turn pin 174 to which is connected a handle 176 at one end. In this way, when the projectile 142 is issued from the simulated gun 120, it can be directed toward one of the targets 166. Upon contact with the target 166, the target will shift about the pin 170 to the "down: position, as illustrated in FIG. 6 of the drawings. When each such targets 166 have been contacted by the projectile 142 and shifted to the down position, the player of the game can merely rotate the handle 176 in a clockwise direction, reference being made to FIG. 7, in order to shift each of the targets 166 to their upright position. Thereafter, the handle 176 is permitted to swing to the position as illustrated in FIG. 5 of the drawings.

It can be observed that the simulated gun range is also designed so that it has no loose or unattached parts. For example, the projectile 142 cannot be inadvertently removed from the toy amusement arcade or lost, and, more importantly, cannot be overshot with respect to the game apparatus, thereby eliminating any possibility of hazard associated with the toy amusement arcade.

Thus, there has been illustrated and described a unique amusement arcade which is designed for children of preschool age and which therefore meets all of the objects and advantages sought therefor. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention which is limited only by the following claims.

Having thus described our invention, what we desire to claim and secure by letters patent is:

1. A children's toy arcade game having a plurality of toy game features, said gam comprising:

a. a game frame means, b. shooter game means simulating a gun range on said frame means, said shooter game means comprising:

1. a projectile shooter member simulating a gun for issuing a projectile,
2. a plurality of aligned target members located to be contacted by said projectile,
3. and flexible connection means connecting said projectile to said shooter game means,
4. manually operable return means operatively connected to said target members to shift said target members to their initial positions.

c. a second game means on said frame means for play with a spherical element, said second game means comprising:

1. a completely enclosed first housing,
2. an optically transparent upper surface forming part of said first housing to view the interior thereof;
3. a spherical element shooter mechanism located in said first housing for issuing a spherical element,
4. a score depicting section having at least one aperture to receive the spherical element to attain a score,
5. an actuating mechanism located externally of said housing member for manual actuation to actuate said shooter mechanism to release the spherical element and to enable same to be moved toward a receiving member, and
6. return means to return the spherical element to the shooter mechanism completely within said first housing, d. a third game means on said frame means, said third game means comprising:

1. a completely enclosed second housing,
2. an optically transparent second upper surface forming part of said second housing to view the interior thereof.
3. a scoring element projecting device for issuing a spherical scoring element,
4. a target section located within said second housing and located to be contacted by said scoring element,
5. a rod mounting said target section in said second housing and said rod extending outwardly of said second housing,
6. linking means operatively connecting said rod to said target section,
7. a simulated bath device located outwardly of said second housing,
8. a simulated person carried on said rod outwardly of said second housing and being pivoted into said simulated bath device when said target section is contacted by said scoring element, and
9. a manually operable return means located externally of said housing and being operatively connected to said rod for returning said simulated person to its initial position, e. means forming a recess in said frame means at each of said game means in proximity to a player end of each of said game means, and f. a simulated player element provided for insertion into said recess at the game means to indicate the game means being played.

2. The children's toy arcade game of claim 1 further characterized in that said second game means comprises a simulated pin ball machine.

3. The children's toy arcade game of claim 1 further characterized in that said target members comprise individual target elements and each of said target elements being connected to said return means such that all target elements are shifted to said intial positions simultaneously.

4. The children's toy arcade game of claim 1 further characterized in that said second game means comprises a game where the player attempts to locate a spherical element in one of a plurality of circularly shaped recesses.

5. A children's toy arcade game having a plurality of toy game features, said game comprising:

a. a game frame means, b. a first game means on said frame means for play with a spherical element and simulating a pin ball game, said first game means comprising:

1. a first completely enclosed housing,
2. an optically transparnet first upper surface forming part of said first housing,
3. a bottom wall forming part of said housing,
4. a spherical element first shooter mechanism located in said first housing for issuing a first spherical element,
5. said bottom wall having a plurality of apertures located therein to receive said first spherical element and each of said apertures representing a different scoring function,
6. an actuating mechanism located externally of said housing member for manual actuation to actuate said first shooter mechanism to release the first spherical element and to enable same to be moved toward said receiving apertures and upon entry in any of said first receiving apertures, generates a first scoring function, and 7. first return means to return the first spherical element to the first shooter mechanism completely within said first housing, c. a second game means on said frame means for play with a spherical element, said second game means comprising:

1. a second completely enclosed housing,
2. an optically transparent second upper surface forming part of said second housing to run the interior thereof,
3. an inclined wall forming part of said second housing,
4. means forming a plurality of concentric and circular spherical element receiving recesses on said inclined wall,
5. a spherical element second shooter mechanism located in said second housing for issuing a second spherical element,
6. an actuating mechanism located externally of said second housing for manual actuation to actuate said second shooter mechanism to release the spherical element and to enable same to be moved toward said receiving recesses and upon entry in said receiving recesses generates a second scoring function which is different than said first scoring function, and
7. second return means to return the second spherical element to the second shooter mechanism completely within said second housing, d. a third game means on said frame means, said third game means comprising:

1. a completely enclosed third housing,
2. an optically transparent third upper surface forming part of said third housing to view the interior thereof,
3. a scoring element projecting device for issuing a spherical scoring element,
4. a target section located within said third housing and located to be contacted by said scoring element,
5. a rod mounting said target section in said third housing and said rod extending outwardly of said third housing,
6. linking means operatively connecting said rod to said target section,
7. a simulated bath device located outwardly of said third housing,
8. a simulated person carried on said rod outwardly of said third housing and being pivoted into said simulated bath device when said target section is contacted by said scoring element, and
9. a manually operable return means located externally of said housing and being operatively connected to said rod for returning said simulated person to its initial position, e. means forming a recess in said frame means at each of said game means in proximity to a player end of each of said game means, and f. a simulated player element provided for insertion into said recesses at the game means to indicate the game means being played.

6. The children's toy arcade game of claim 5 further characterized in that said game comprises shooter game means simulating a gun range on said frame means, said shooter game means comprising:

1. a projectile shooter member simulating a gun for issuing a projectile,
2. a plurality of aligned target members located to be contacted by said projectile,
3. and flexible connection means connecting said projectile to said shooter game means, and
4. manually operable return means operatively connected to said target members to shift said target members to their initial positions.

7. The children's toy arcade game of claim 6 further characterized in that said target members comprises individual target elements and each of said target elements being connected to said return means such that all target elements are shifted to said initial positions simultaneously.

* * * * *